US005683540A

United States Patent [19]

Lukins et al.

[11] Patent Number: 5,683,540

[45] Date of Patent: Nov. 4, 1997

[54] METHOD AND SYSTEM FOR ENHANCING THE SURFACE OF A MATERIAL FOR CLEANING, MATERIAL REMOVAL OR AS PREPARATION FOR ADHESIVE BONDING OR ETCHING

[75] Inventors: Ronald E. Lukins, Whittier; Daniel R. Bell, III, Riverside, both of Calif.

[73] Assignee: Boeing North American, Inc., Seal Beach, Calif.

[21] Appl. No.: 494,867

[22] Filed: Jun. 26, 1995

[51] Int. Cl.[6] ..... B44C 1/22

[52] U.S. Cl. ..... 156/345; 216/67; 134/1

[58] Field of Search ..... 156/345 P, 643.1, 156/272.6; 134/1, 201; 216/67

[56] References Cited

U.S. PATENT DOCUMENTS

| | | | |
|---|---|---|---|
| 3,462,335 | 8/1969 | Hansen et al. | 156/272 |
| 4,421,843 | 12/1983 | Hattori et al. | 430/322 |
| 4,564,576 | 1/1986 | Saigo et al. | 430/197 |
| 4,588,641 | 5/1986 | Haque et al. | 428/413 |
| 4,637,851 | 1/1987 | Ueno et al. | 156/272.6 |
| 4,665,006 | 5/1987 | Sachdev et al. | 430/270 |
| 4,731,156 | 3/1988 | Montmarquet | 156/643 |
| 4,745,169 | 5/1988 | Sugiyama et al. | 528/43 |
| 4,765,860 | 8/1988 | Ueno et al. | 156/272.6 |
| 4,772,348 | 9/1988 | Hirokawa et al. | 156/272.6 |
| 4,897,154 | 1/1990 | Chakravarti et al. | 156/643 |
| 4,956,314 | 9/1990 | Tam et al. | 437/241 |
| 4,981,551 | 1/1991 | Palmour | 156/643 |
| 4,985,342 | 1/1991 | Muramoto et al. | 430/280 |
| 5,013,400 | 5/1991 | Kurasaki et al. | 156/643 |
| 5,019,210 | 5/1991 | Chou et al. | 156/643 |
| 5,308,428 | 5/1994 | Simpson et al. | 156/272.6 |

*Primary Examiner*—William Powell

*Attorney, Agent, or Firm*—Harry B. Field; Lawrence N. Ginsberg

[57] ABSTRACT

A system and process for enhancing the surface of a material for cleaning, material removal or preparation for adhesive bonding or etching. An environment is provided which includes a skin region in which charged particles may be generated. An exposure region is spaced from the skin region. A material may be positioned in the exposure region which contains neutral, chemically active particles generated by the charged particles. When the material to be altered is positioned in the exposure region, a desired surface of the material chemically reacts with the neutral, chemically active particles so as to alter the surface as desired for cleaning, material removal or as preparation for adhesive bonding or etching.

11 Claims, 3 Drawing Sheets

METHOD AND SYSTEM FOR ENHANCING THE SURFACE OF A MATERIAL FOR CLEANING, MATERIAL REMOVAL OR AS PREPARATION FOR ADHESIVE BONDING OR ETCHING

BACKGROUND OF THE INVENTION

1. Field of the Invention

The present invention relates to enhancing the surface of a material for cleaning, material removal or for the preparation for adhesive bonding or etching, and more particularly to the generation and use of neutral, chemically active particles to chemically react with a material surface so as to alter the surface as desired for the cleaning, material removal or preparation for adhesive bonding or etching.

2. Description of the Related Art

Large scale low-temperature plasma related methods and devices are needed for surface cleaning and pre-conditioning prior to bonding materials, for both laboratory, manufacturing, and field applications. One of the problems encountered in developing such procedures and devices is scaling up the desired environment, which produces desired material effects on a small scale, such that large scale exposure can be performed with the same characteristics. The coupling of system parameters is strong for low-temperature plasma systems. Hence, this coupling makes scaleup difficult since both substrate temperatures and reactive species need to be controlled or altered, and since the coupling of operating parameters which influence reactivity and temperatures severely restrict the degree of such controllability. Identification of the skin effect, whereby electromagnetic field penetration into a reaction zone is limited owing to the proper conductive nature of a discharge or plasma region, and understanding of the coupling of parameters which leads to skin effects (and hence non-uniformity of electromagnetic fields in the reaction zone) makes scaleup and manipulation of desired surface preparation environments relatively predictable and controllable.

U.S. Pat. No. 4,588,641, issued to Haque et al., discloses a 3-step plasma treatment for improving a laminate adhesion of metallic and non-metallic substrates. The treatment comprises sequentially exposing the substrate to a first plasma of oxygen gas, a second plasma of a hydrocarbon monomer gas and a third plasma of oxygen gas. The process has particular utility in forming polymeric films on one or more surfaces of copper or copper alloy foils to be used in printed circuit applications.

U.S. Pat. No. 3,462,335, issued to R. H. Hansen et al., discloses subjecting hydrocarbon, fluorocarbon and polyamide polymers to a stream of excited inert gas.

U.S. Pat. No. 4,765,860 issued to S. Ueno et at, discloses a method for the preparation of a flexible base for printed circuit board of the type formed of lamination a flexible sheet-like polymeric base and a metal, e.g. copper, foil adhesively bonded thereof by use of an adhesive, in which the surface of the polymeric base prior to bonding of the metal foil is subjected to exposure to low temperature plasma so that the adhesive bonding strength between the polymeric base and the metal foil can be improved.

None of the above described references discusses manipulation of the skin region and field effects containing charged particles for the purpose of providing a separate skin region and exposure region to allow controllability of chemical reaction with neutral, chemically reactive particles and for system designs so that the process may be scaled up.

SUMMARY OF THE INVENTION

The present invention is a system and process for enhancing the surface of a material for cleaning, material removal or preparation for adhesive bonding or etching. An environment is provided which includes a skin region in which charged particles and nuclear reactive particles may be generated. An exposure region is spaced from the skin region. A material may be positioned in the exposure region which contains neutral, chemically active particles generated by impact with the charged particles. When the material to be altered is positioned in the exposure region, a desired surface of the material chemically reacts with the neutral, chemically active particles so as to alter the surface as desired for cleaning, material removal or as preparation for adhesive bonding or etching.

Utilization of the distinction between the exposure region and the skin region provides the ability to identify and control the parameters which influence substrate pre-conditioning when designing methods and devices for scaleup applications. Replication of material surface enhancements from small scale to large scale surfaces has, in the past, been difficult or impossible. The principals of this invention allow use and design of systems which produce electromagnetic fields (expressed in terms of a skin depth parameter), which are non-uniform h nature allowing manipulation and control of substrate temperature, surface reactivity, and other material effects. This benefits scaleup applications since systems can be configured and manipulated in a predictable manner to balance the desired parameters influencing surface conditioning.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures are designated by the same reference characters.

DETAILED DESCRIPTION OF THE PREFERRED EMBODIMENT

Figure 2:
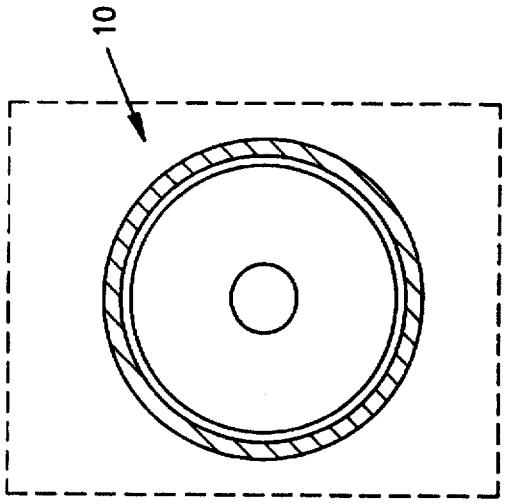
FIG. 2 is a side view of the FIG. 1 embodiment taken along line 2—2 of FIG. 1.
Figure 1:
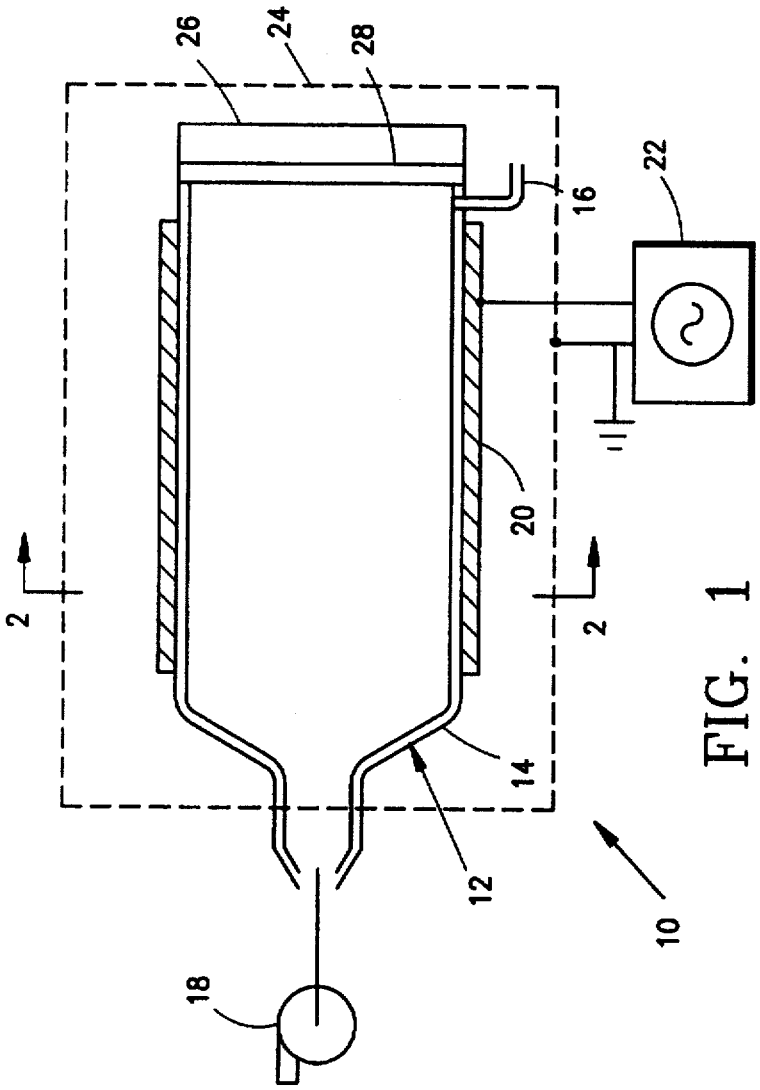
FIG. 1 is a schematic, cross-sectional view of a first embodiment of the present invention in which a reaction chamber is utilized in conjunction with an rf electrode to provide the necessary environment of the present invention.

Referring to the drawings and the characters of reference marked thereon, FIGS. 1 and 2 illustrate a first embodiment of the present invention, designated generally as 10. System 10 includes a reaction chamber assembly 12, including a reaction chamber 14, a parent (feed) gas inlet 16 for introducing a parent gas into the reaction chamber 14 and a vacuum pump 18 for providing a vacuum within the reaction chamber assembly 12. The reaction chamber 14 is preferably formed of quartz glass. Quartz is preferably used because it provides a consistent exposure environment, i.e. the interior surface of the glass does not often react with the reactant bi-products. Less preferred materials for the reaction chamber 14 include other glasses, metals and composites such as graphite epoxy and fiberglass, which are relatively un-reactive. The reaction chamber 14 illustrated is cylindrical, however, it is understood that it may be of any other geometry that fits a desired geometrically shaped material that will be exposed. The chamber dimensions, coupled with the material geometry, influence the skin depth, as will be explained below in detail.

The vacuum pump 18 should be of a type that is oxygen compatible, have a flow restriction valve, and it should operate in a "rough" pressure range of about 0.014 to 104. The vacuum pump 18 may have a sieve filtering system and a separate inlet feed for nitrogen gas.

The parent gas inlet 16 typically has a regulator flow valve. A preferred parent gas is oxygen. Other parent gases may include diatomic gases. Other gases may be utilized that have neutral, chemically active species. An rf electrode 20 is located about a peripheral surface of the reaction chamber 14 for generating charged particles and forming the skin region. The rf electrode 20 may comprise metal sheets, or metal tubing. It may also comprise polymeric or plastic non-conductive materials with metalized surfaces. Although not shown in the Figure, the rfelectrode may have a jagged inner surface for increasing field strength. Although one rf electrode 20 is shown, it is understood that there may be multiple electrodes, the shape and sizes thereof tailored to a particular application to localize the plasma region.

An rf power source 22 is connected to the rf electrode 20 for providing power to the rf electrode 20. The rf power source 22 comprises a generator and an impedance matching network such that the matching network is designed for use with a specific electrode configuration. The matching network can be tunable or selectively designed for specific field generation.

The system 10 preferably includes a Faraday shield or cage 24 positioned about the periphery of the reaction chamber assembly 12. The Faraday shield 24 is connected to an electrical ground to provide electrical isolation of the reaction chamber assembly 12 to ambient. The Faraday shield 24 may be formed of a conductive material such as aluminum plate, copper plate, or cross-hatched wire. It may be formed of a mesh material, metalized film, etc. The test material may be introduced to the reaction chamber assembly 12 via a glass plate 26 and seal 28. The seal 28 may be, for example, plastic or silica or RTV rubber. Plate 26, although preferably glass, may be formed of other suitable materials.

The material for which the surface is desired to be enhanced is introduced into the vacuum chamber assembly 12. It may be introduced with or without a specimen support or holder. In operation, the vacuum is pulled and the parent gas is fed into the reaction assembly 12. The rf power is applied until the rf plasma operating in the low discharge regime is initiated.

When power is supplied to system 10, a specific environment is created. This environment includes a skin region and an exposure region. The skin region includes that portion of the environment in which charged particles are generated. The exposure region is spaced from the skin region. The exposure region is that portion of the environment in which the material be positioned. The exposure region contains neutral, chemically active particles generated by the charged particles formed within the skin region. When the material is positioned in the exposure region, a desired surface of the material chemically reacts with the neutral, chemically active particles, so as to alter the surface as desired for clearing, material removal or as preparation for adhesive bonding or etching.

The (plasma) skin region is created in the reaction chamber, between the chamber wall and the skin boundary. Within this region, the combination of the three parameters: electromagnetic field strength (E) gas pressure (p) and parent gas feed rate (F)—are sufficient to uniquely define the skin region with the use of classical electrodynamic models and a fluid approximation for charged particles.

At a given pressure, gas flow rate and parent gas feed rate, there is a minimum electric field required to sustain a plasma.

Under an appropriate set of conditions (geometry, p, F, E) the skin region does not fill the entire chamber volume; i.e., as skin region and separate exposure region. In such an instance, there is separation of electrons and ions within the skin region and the plasma is said to be non-uniform and/or spatially inhomogenous. The skin boundary separating charged particles from the remaining volume depends upon the nature of the contents within the chamber, chamber housing material, electrode and housing geometry; current voltage and phase at the rf electrodes, parent gas feed rate, and pressure within the reaction chamber. The skin region is describable in mathematical terms as follows:

The theoretical model upon which the present invention is based relates steady-state volume-averaged atomic oxygen (AO) mole fraction to the operating parameters; reaction chamber pressure, inlet oxygen feed rate, and power delivered to the reaction chamber, and other necessary system dependent parameters. To predict atomic oxygen mole fraction, volume averaged electron density and oxygen dissociation rate constants must also be known. The following provides a correlation between electron density, measureable reactor parameters, and various constant s for specific systems.

A first step in predicting AO mole fraction is to consider that only a limited number of reactions occur in an empty chamber. The following are most likely to occur;

(1) Electron impact dissociation $e+O_2 \rightarrow 2O$ (2) Atomic oxygen recombination $2O + O_2 \rightarrow 2O_2$ (3) Wall recombination (kw)

$$O + O \xrightarrow[\text{impact}]{\text{wall}} 2O_2$$

Simple mass balance consideration leads to the following expression for steady-state atomic oxygen mole fraction;

$$\langle N_o/N\rangle = \langle k_1 \times n\rangle (1-exp(2\tau A)/A$$

where $\langle k_1\rangle$=molecular oxygen dissociation rate constant $$A = 2\langle k_1 \times n\rangle + \langle kw\rangle$$

$\tau$=molecular oxygen residence time $\langle\eta\rangle$=steady-state volume average electron density Quantities bracketed by the symbol <> denote steady-state volume averaged quantities. The model for electron density generated in the subject devices is used in conjuction with a model as described above to permit prediction of AO mole fraction. The remaining discussion focuses on predicting $\langle\eta\rangle$.

A useful approach for modeling $\langle\eta\rangle$ is to calculate the power delivered to the reaction chamber (i.e. the internal problem). Calculating this discharge power, instead of the power delivered by the power supply, plays a key role in understanding the operation of these systems. The key in developing such models is to calculate the electromagnetic fields in terms of a simple skin depth parameter. The model will be shown to relate to neutral gas temperature and pressure, average electron energy, electron-neutral collisional cross-section, coil current, voltage, and phase. The desired model is derived using the principle of classical electro-dynamics, kinetics, and employing an electron fluid equation of motion. At frequency's generally in excess of 1 Mhz, the ions only jostle about and net ion currents are estimated to be low. Some exceptions are noted however in the literature. The approach to calculate discharge power is to calculate the electromagnetic fields and current density in the reaction zone, and use the following general relationship between discharge power and these quantities;

General Expressions and Relationships for One-Dimensional Problems

| | |
|---|---|
| $P = 1/2\int J \cdot E dV$ | Discharge Power |
| $J = \sigma E,\ \sigma = c^2/2\pi\omega\delta^2$ | Current Density & Electron Conductivity |
| $E(r,a,\delta) = Vo/L \cdot \Psi(r,a,\delta)\cos\{kz - \omega\Phi(r,a,\delta)\}$ | Electric field |

$V_o$=Constant Voltage at the electrode input connection from the matching network L=Typical chamber length dimension $\alpha$=Typical chamber cross dimension $\delta$=Skin depth parameters $\sigma$=Electron conductivity $\Psi$=Geometrical function of system configuration k=Power source wavenumber z=Chamber axial position $\Phi$=Radial and skin depth dependent electric field phase $\omega$=Power source driving frequency The electron current density is also related to the field (as an example in a simple form) by the electron fluid equation of motion, $$m dv/dt = -e(E + vxB) + mv\upsilon$$

where $J = \langle\eta\rangle ev = mv\upsilon$ v=electron average velocity $\upsilon$=electron-neutral collisional frequency $mv\upsilon$ m=electron mass B=magnetic induction field e=electron charge Application of the above general procedure result to the case of molecular oxygen feed gas in a solenoidal coil (external to the reaction chamber) yields:

For the Solenoidal Coil Case $$E = Vo/L\ M(r,a,\delta)\cos(kz - wt - \Phi(r,a,\delta)$$

$$M^2(r,a,\delta) = \frac{\{(R(r)R(a) + Q(r)Q(a))^2 + (R(a)Q(r) - Q(a)R(r))^2\}}{\{R^2(a) + Q^2(a)\}^2}$$

$$\Phi(r,a,\delta) = \frac{R(a)Q(r) - R(r)Q(a)}{R(r)R(a) + Q(r)Q(a)}$$

$$R(a) = R(r)_{r=a}$$

$$Q(a) = Q(r)r = a$$

$$R(r) = \sum_{k=0}^{\infty} \frac{(-1)^k(\sqrt{2}r/2\delta)^{2k}\cos(\pi k/2)}{k!k!}$$

$$Q(r) = \sum_{k=0}^{\infty} \frac{(-1)^k(\sqrt{2}r/2\delta)^{2k}\sin(\pi k/2)}{k!k!}$$

These expressions for the fields, along with their generalized counterparts above, define the discharge power in terms of the skin depth parameter.

Through the above theoretical description, the location of charged particles is defined through the field expressions in terms of the skin depth parameters. Note, the skin depth parameter is used to help determine the spatial location of the charged particles. It is the electric field strength and pressure which largely determines the region(s) where the charged particles exist. Hence, there is a region, the skin region in which the charged particles are confined. Atomic oxygen (and other neutral species) is produced in the skin region (owing to collisions with electrons) but since AO is electrically neutral, these AO atoms travel at thermal velocities (large compared to typical chamber dimensions), with no electrical influence. Hence the reaction volume can be, and is frequently isolated from the skin region. The reactivity of material mad the resultant temperature are influenced by the presence of charge particle impingement. Isolation and position control of charge particles, using the skin region concept allows one to adjust the operating parameters to change or create a skin region, thereby producing often desirable exposure conditions. Use of the neutral particles allows for scalability as well.

Figure 3:
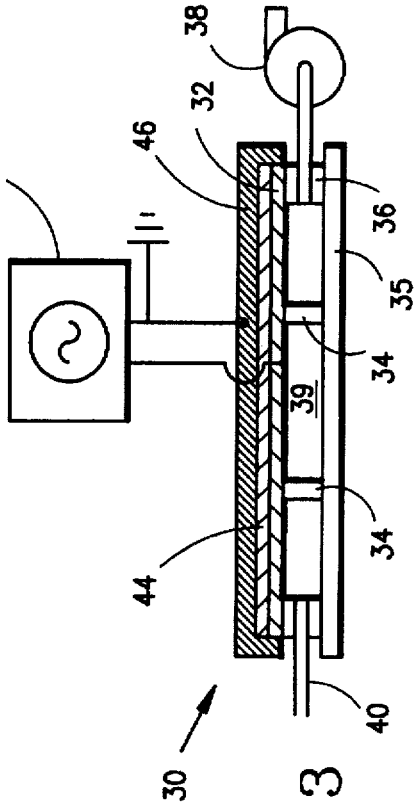
FIG. 3 is a schematic, cross-sectional view of a second embodiment in which an rf electrode is maintained in spaced relationship with the material to be exposed and a vacuum formed therebetween, which serves as the exposure region.

Referring now to FIG. 3, a second embodiment of the present invention is illustrated, designated generally as 30. System 30 includes an environment which comprises an rf electrode 32 for generating the charged particles and forming the skin region. Positioning means, i.e. spacers 34 position the material to be exposed in spaced relationship with the rf electrode 32. The positioning means includes a side wall 36 for providing access to a vacuum 38 in the space formed between the rf electrode 32 and the material 35. A parent gas inlet 40 is provided for introducing a parent gas into the space 39. An rf power source 42 is connected to the rf electrode 32 for providing power to the rf electrode 32.

System 30 also preferably includes an electrical insulator 44 positioned adjacent the rf electrode 32 and a Faraday shield 46 positioned on top of the electrical insulator 44, so that the electrical insulator 44 is sandwiched between the Faraday shield and the rf electrode 32, so as to provide electrical insulation of the system 30 from the external environment.

The electrical insulator 44 preferably comprises Kapton® or another suitable polymer or plastic. The spacers 34 are preferably formed of a non-conductive polymer or plastic. The space 39 is sufficiently wide to encompass a defined skin region separated from the exposure region in which the material is to be tested is positioned.

Figures 4, 5:
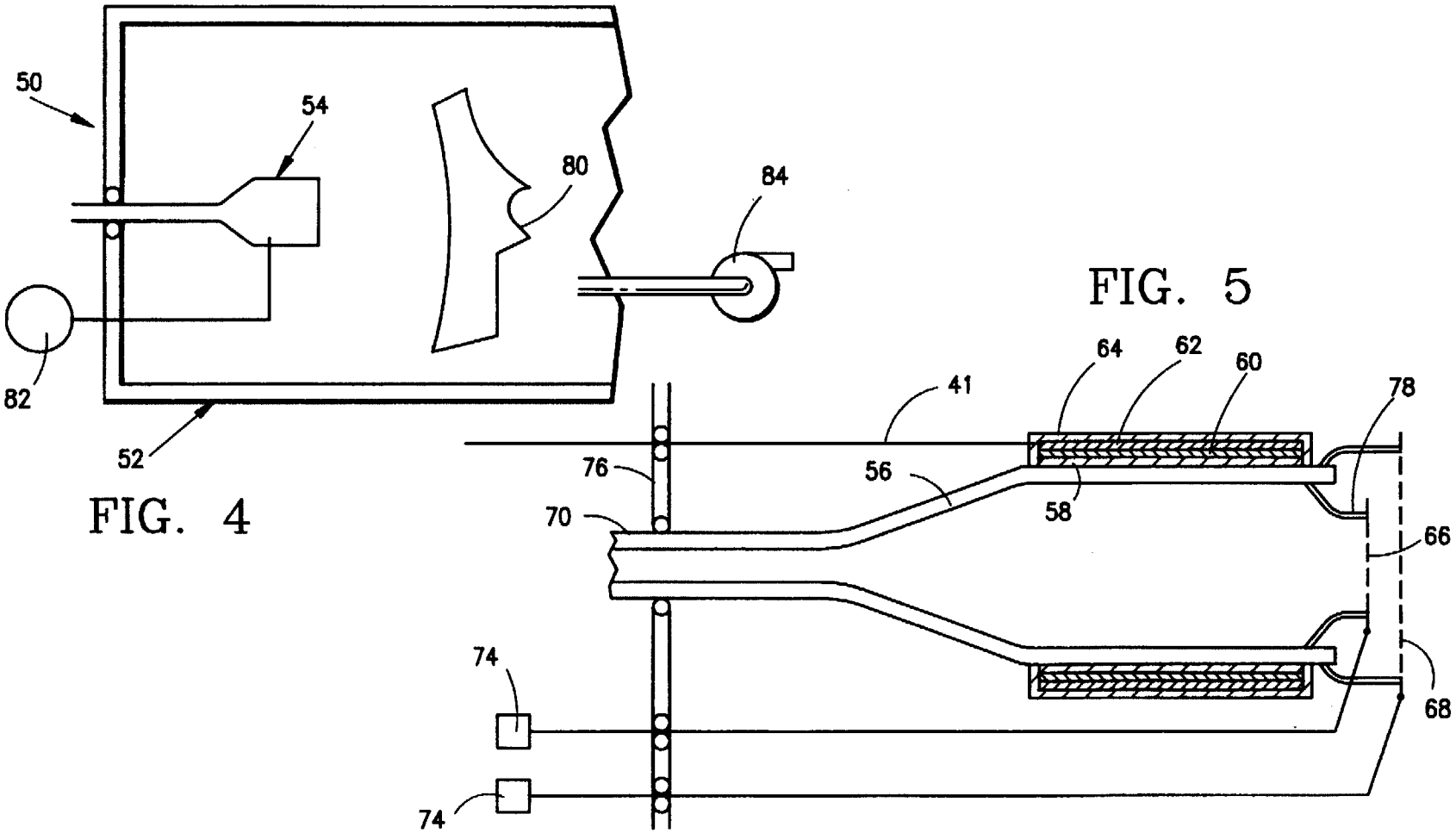
FIG. 4 is a schematic view, partially in cross-section, of a third embodiment in which a probe assembly is utilized in a vacuum chamber to provide the skin required in accordance with the principles of the present invention.
FIG. 5 is an enlarged, cross-sectional view of the probe assembly shown in FIG. 4.

Referring now to FIGS. 4 and 5, a third embodiment of the system of the present invention is illustrated, designated generally as 50. System 50 includes an environment comprising a vacuum chamber, designated generally as 52. A probe assembly, designated generally as 54 is positioned in the vacuum 52. The probe assembly 54 comprises a housing 56. The housing 56 is preferably formed of quartz glass. An rf electrode 58 is located at a peripheral edge of the housing 56. An electrical insulator 60, i.e. Kapton®, is located about an outer surface of the rf electrode 58. A Faraday shield 62 is located about an outer surface of the electrical conductor 60. A glass cover 64 is located about an outer surface of the Faraday shield 62. First and second spaced bias grids 66, 68 are positioned at an end of the housing 56 for accelerating charged particles generated within the probe assembly 54. A parent gas inlet 70 provides introduction of a parent gas into the volume of the housing 56.

An rf power source 72 is connected to the rf electrode 58 providing power to the probe assembly 54. DC power source means 74 are connected to the spaced bias plates 66, 68 for providing voltage to the grids 66, 68. There is a feed through in the front 76 of the chamber wall that allows adjustable positioning of the probe 54. This adjustability allows various sized parts to be plied in the chamber 52 and manipulation of the skin region to allow for optimum processing.

A support structure 78 supports and positions the bias grids 66, 68 relative to the housing 56. The grids 66, 68 are shaped to meet charged particle distribution requirements. Substrate material 80 to be exposed is shown in the exposure region, in FIG. 4. A specimen holder may be utilized (now shown). A first vacuum pump 82 may be utilized to provide vacuum pumping directly within the probe 54. A second vacuum pump 84 is used to provide a vacuum within the vacuum chamber 52.

Figures 6, 7:
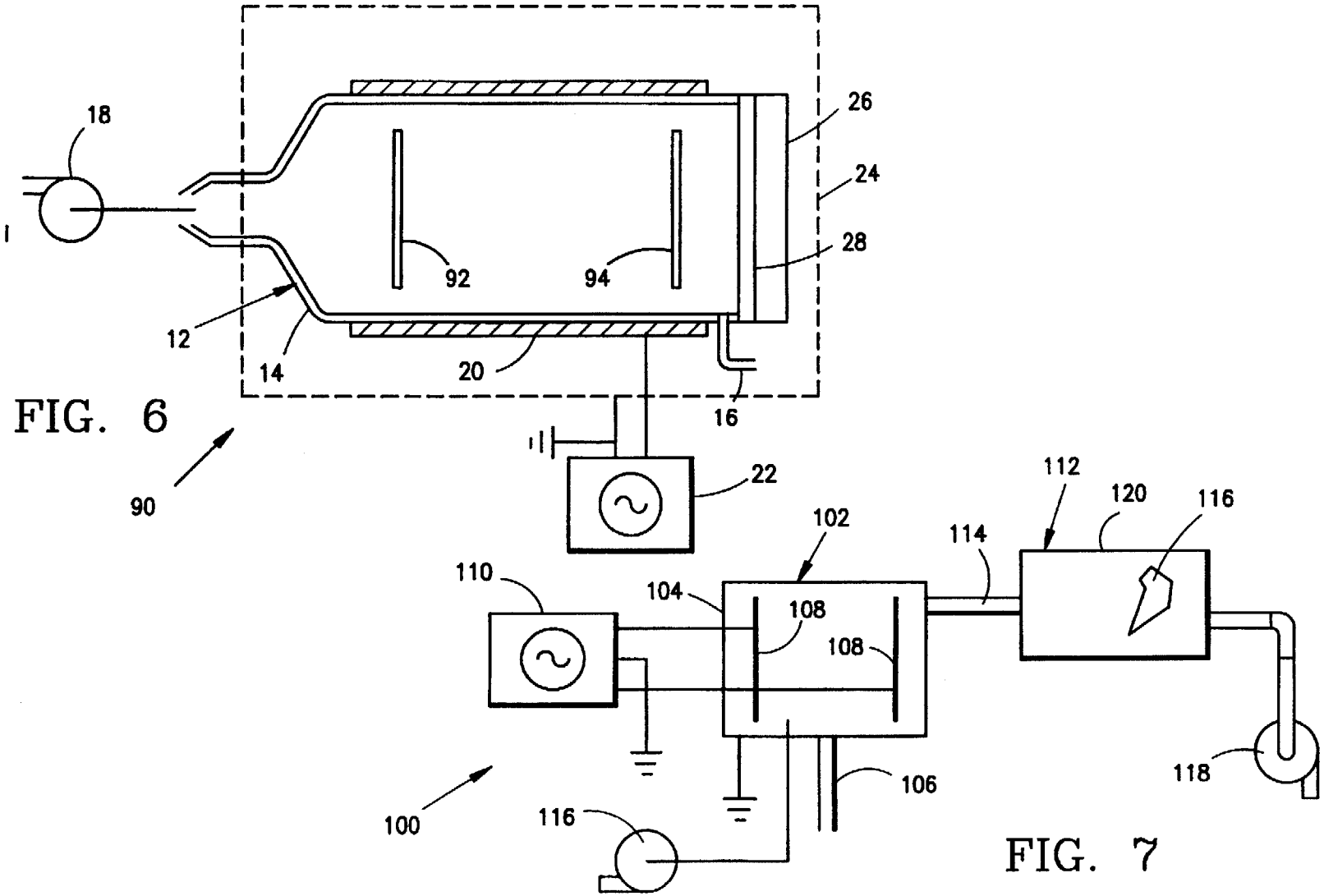
FIG. 6 is a schematic, cross-sectional view of a fourth embodiment in which a reaction chamber is utilized in conjunction with an rf electrode and spaced bias grids.
FIG. 7 is a schematic illustration of a fifth embodiment in which an exposure chamber is in fluid communication with a reaction chamber assembly.

Referring now to FIG. 6, a fourth embodiment of the system of the present invention is illustrated, designated generally as 90. System 90 is essentially the same as the FIG. 1–2 embodiment; however, this embodiment includes bias plate grids 92, 94 within the reaction chamber assembly 12. The bias plates 92, 94 allow for repositioning and manipulation of the skin region, as desired. It is noted that although the bias grids are shown to be flat, they may be shaped as so desired to provide to manipulate the skin region as needed.

Referring now to FIG. 7, a fifth embodiment of the present invention is illustrated, designated generally as 100. System 100 includes a reaction chamber assembly, designated generally as 102, which includes a reaction chamber 104 and a parent gas inlet 106 for introducing a parent gas into the reaction chamber 104. Spaced ff electrodes 108 are positioned in the reaction chamber assembly 102. The rf electrodes preferably have glass plates surrounding them (not shown) to separate the active species from the electrodes. This retains electrode integrity. An rf power source 110 is connected to the electrodes 108 for providing power to the electrodes 108. An exposure chamber 112 is in fluid communication via conduit 114 with the reaction chamber assembly 102. The reaction chamber contains the material 116 to be exposed. Vacuum pump means 116, 118 are provided for providing vacuums in the reaction chamber assembly 102 and exposure chamber 112. A vacuum sealed removable face plate 120 provides access to the exposure chamber 112 for the material 116. Water cooling systems (not shown) may be utilized to control the reactor wall temperature and the exposure chamber wall temperature. The vacuum pumps in all of the above embodiments should preferably include flow restriction valves for adjusting pressure.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A system for enhancing the surface of a material for cleaning, material removal or preparation for adhesive bonding or etching, comprising:

an environment including:

a) a skin region in which charged particles may be generated; and b) an exposure region spaced from said skin region, in which a material may be positioned, said exposure region containing neutral, chemically active particles generated by said charged particles, wherein when said material is positioned in said exposure region, a desired surface of said material chemically reacts with said neutral, chemically active particles so as to alter said surface as desired for cleaning, material removal or as preparation for adhesive bonding or etching.

2. The system of claim 1, wherein said environment comprises:

a) a reaction chamber assembly, including a reaction chamber, a parent gas inlet for introducing a parent gas into said reaction chamber, and means for providing a vacuum within said reaction chamber;

b) rf electrode means located about a peripheral surface of said reaction chamber for generating said charged particles and forming said skin region; and, c) an rf power source connected to said rf electrode means for providing power to said rf electrode means.

3. The system of claim 2, further including a Faraday shield positioned about the periphery of said reaction chamber assembly, said Faraday shield being connected to said rf power source to provide electrical isolation of said reaction chamber assembly.

4. The system of claim 2, wherein said reaction chamber is formed of quartz glass.

5. The system of claim 1, wherein said environment comprises:

a) rf electrode means for generating said charged particles and forming said skin region;

b) positioning means for positioning said material to be exposed in spaced relationship with said rf electrode means, said positioning means including means for providing a vacuum in the space formed between said rf electrode means and said material;

c) a parent gas inlet for introducing a parent gas into said space;

d) an rf power source connected to said rf electrode means for providing power to said rf electrode means.

6. The system of claim 5, further including an electrical insulator material positioned adjacent said rf electrode means and a Faraday shield positioned on top of said electrical insulator so that said electrical insulator is sandwiched between said Faraday shield and said rf electrode means so as to provide electrical isolation of said system to the external environment.

7. The system of claim 1, wherein said environment comprises:

a) a vacuum chamber;

b) a probe assembly positioned in said vacuum chamber, said probe assembly comprising:

i) a housing;

ii) rf electrode means located by the peripheral edge of said housing;

iii) an electrical insulator located about an outer surface of said rf electrode means;

iv) a Faraday shield located about an outer surface of said electrical insulator;

v) a glass cover located about an outer surface of said Faraday shield;

vi) first and second spaced bias grids positioned at an end of said housing for accelerating charged particles generated within said probe assembly;

vii) a parent gas inlet for introducing a parent gas into the volume of said housing;

c) an rf power source connected to said rf electrode means for providing power to said probe assembly; and, d) DC power source means connected to said spaced grids means for providing voltage to said grids.

8. The system of claim 7, wherein said electrode means comprises a metal film.

9. The system of claim 7, wherein said housing is formed of glass.

10. The system of claim 1, wherein said environment comprises:

a) a reaction chamber assembly, including a reaction chamber, a parent gas inlet for introducing a parent gas into said reaction chamber, and means for providing a vacuum within said reaction chamber;

b) rf electrode means located about a peripheral surface of said reaction chamber for generating said charged particles and forming said skin region;

c) an rf power source connected to said rf electrode means for providing power to said rf electrode means; and, d) first and second spaced bias grids positioned in said reaction chamber assembly for accelerating said charged particles generated within said reaction chamber assembly.

11. The system of claim 1, wherein said environment comprises:

a) a reaction chamber assembly, including a reaction chamber, and a parent gas inlet for introducing a parent gas into said reaction chamber;

b) rf electrode means positioned in said reaction chamber assembly;

c) an rf power source connected to said rf electrode means for providing power to said rf electrode means;

d) an exposure chamber in fluid communication with said reaction chamber, said exposure chamber for containing said material to be exposed; and e) means for providing a vacuum in said reaction chamber and exposure chamber.

* * * * *

UNITED STATES PATENT AND TRADEMARK OFFICE

CERTIFICATE OF CORRECTION

PATENT NO. : 5,683,540

DATED : November 4, 1997

INVENTOR(S) : Ronald E. Lukins, Daniel R. Bell III

It is certified that error appears in the above-identified patent and that said Letters Patent is hereby corrected as shown below:

Column 5, line 41, delete "α" and substitute therefor --a--

Column 6, line 36, delete "mad" and substitute therefor --and--

Column 7, line 23, delete "plied" and substitute therefor --placed--

Column 7, line 49, delete "ff" and substitute therefor --rf--

Column 7, line 63, delete "wail" and substitute therefor --wall--

Column 1, Line 53, delete "at" and substitute therefor --al--

Column 2, line 26, delete "h" and substitute therefor --in--

Column 3, line 33, delete "rfelectrode" and substitute therefor --rf electrode--

Column 4, line 62, delete "x" and substitute therefor --><--

Column 4, line 66, delete "x" and substitute therefor --><--

Signed and Sealed this

First Day of September, 1998

*Attest:*

*Attesting Officer*

Bruce Lehman

BRUCE LEHMAN

*Commissioner of Patents and Trademarks*